United States Patent [19]

Stock et al.

[11] 4,098,025

[45] Jul. 4, 1978

[54] DOOR ASSEMBLY AND METHOD OF CONSTRUCTION SAME

[75] Inventors: Mark E. Stock, McSherrystown; Edward F. Sherwood, Gettysburg, both of Pa.

[73] Assignee: Westinghouse Electric Corp., Pittsburgh, Pa.

[21] Appl. No.: 806,398

[22] Filed: Jun. 14, 1977

[51] Int. Cl.[2] ..... E05D 7/08

[52] U.S. Cl. ..... 49/388; 49/398; 49/400; 49/501

[58] Field of Search ..... 49/388, 398, 400, 399, 49/169, 171, 381, 501; 16/128, 135

[56] References Cited

U.S. PATENT DOCUMENTS

| | | | |
|---|---|---|---|
| 672,341 | 4/1901 | Taylor | 49/169 X |
| 1,284,228 | 11/1918 | Brerig | 49/400 X |
| 3,300,900 | 1/1967 | Risk et al. | 49/400 X |
| 3,604,154 | 9/1971 | Curran | 49/388 X |

*Primary Examiner*—Kenneth Downey
*Attorney, Agent, or Firm*—D. R. Lackey

[57] ABSTRACT

A door assembly, and method of constructing same, including a door, and a wall panel having an opening sized to receive the door. The door is mounted in the opening of the wall panel on concealed, tamper-proof pivot hinges. The pivot hinges are held captive to the door via elongated fasteners during assembly, with the elongated fasteners subsequently functioning as concealed pivot pins about which the door is swingable.

8 Claims, 7 Drawing Figures

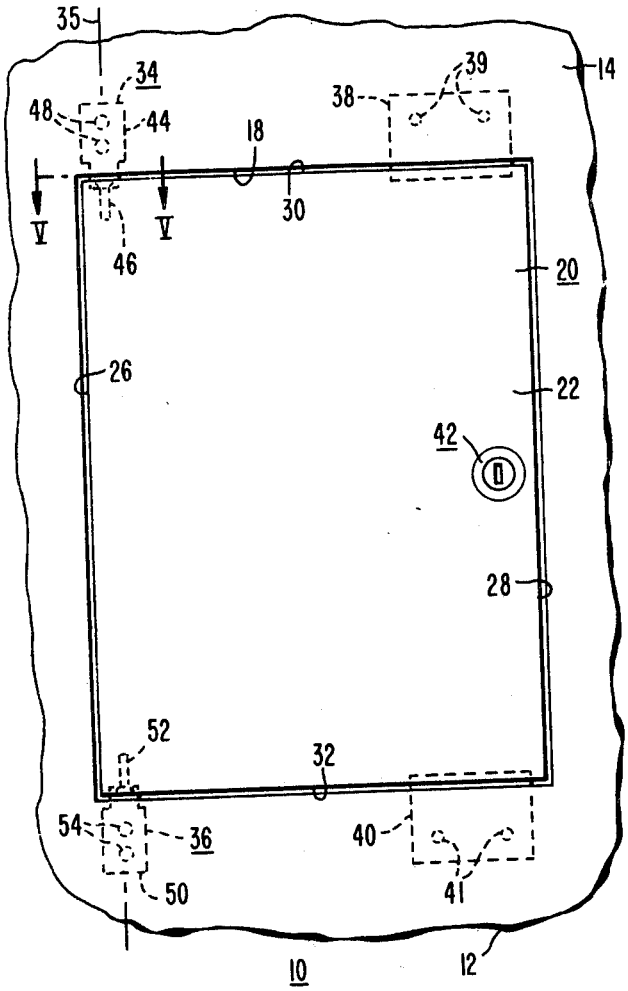
FIG.1
FIG.5
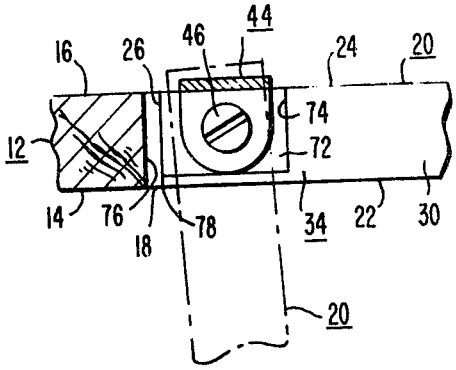
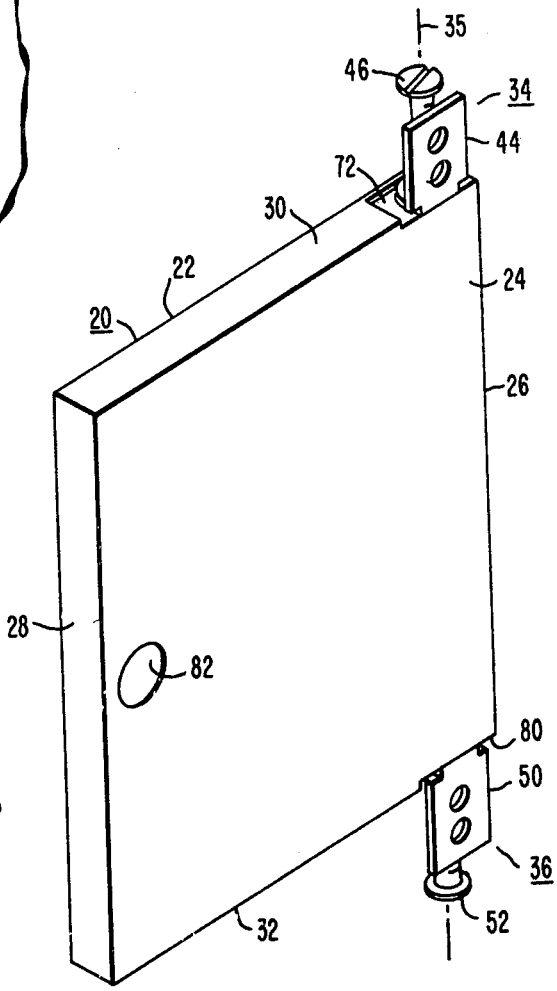
FIG.6

DOOR ASSEMBLY AND METHOD OF CONSTRUCTION SAME

BACKGROUND OF THE INVENTION

1. Field of the Invention

The invention relates in general to door assemblies, and methods of constructing same, and more specifically to door assemblies which include a door mounted in an opening in a wall panel wherein the wall panel completely surrounds the door.

2. Description of the Prior Art

Certain applications require that a relatively small door be installed in a wall panel, using concealed, tamper-proof hinges. For example, such a door is required in the wall panel of an elevator car for concealing controls to be used only by authorized personnel. A key-operated lock is utilized to prevent unauthorized entry. Such a door may also be used to conceal a telephone in an elevator car, which may be used during an emergency to summon help. Since the door must open outwardly into the car, butt-type hinges cannot be used, as the pins would be accessible and subject to tampering.

In the prior art, these doors are usually mounted via special expandable hinges which are concealed when the door is closed. These special expandable hinges require very little space between the door and adjacent wall panel, presenting a pleasing appearance, as the door blends smoothly with the associated wall panel. These special hinges require hinge elements to be routed into one vertical door edge, and cooperative hinge elements to be routed into the facing edge of the wall panel. Pins then interlock the cooperative hinge elements mounted on the door and wall panel. These special hinges are relatively costly to purchase and install. They are subject to wear, which results in sagging of the door. They are concealed and tamper-proof while the door is closed, but the pins may be removed when the door is open. Thus, it would be desirable to provide a new and improved door assembly, and method of constructing same, which overcome the hereinbefore mentioned disadvantages, while retaining the concealment and tamper-proof features of the mounting hardware provided by specially constructed prior art hinges.

SUMMARY OF THE INVENTION

Briefly, the present invention is a new and improved door assembly, and method of constructing same, which includes a door pivotally mounted in an opening defined by a wall panel. Concealed, tamper-proof pivot hinges are formed of easily fabricated first and second right angle members which have one arm fastened to the top and bottom edges, respectively of the door, adjacent to a selected vertical edge of the door. Elongated fastening means is utilized to secure each angle member to the door, with the longitudinal axes of the fastening means being disposed on a common vertical axis.

The elongated fastening means holds the right angle members captive to the door. The door may then be placed in the opening in the wall panel and blocked for proper clearances. The remaining arms of the first and second right angle members will be flush against the back side of the wall panel, and they are secured in this position via suitable fastening means.

The elongated fastening means, which initially function strictly as fasteners to hold the right angle members captive during the assembly process, now function as pivot pins. The hinges and the elongated fastening means are concealed when the door is closed, and also when the door is open. Once the wall panel, with the door assembly mounted thereon, is placed in position, such as in an elevator car, it is not possible to remove the elongated fastening means, i.e., the pivot pins, as they are positioned between the door and the wall panel in any door position.

The pivot hinges and door assembly of this invention provide a more rigid, stronger assembly than achievable with special prior art concealed hinges. The door maintains its original position, without sag, even after considerable usage. The concealed pivot hinges of the invention require very little clearance between the door and adjacent wall panel, retaining this desirable feature of prior art concealed hinges. Assembly of the door panel is simplified because routing of the wall panel is eliminated, and because the hinge is held captive to the door while the hinge is being secured to the wall panel.

BRIEF DESCRIPTION OF THE DRAWINGS

The invention may be better understood, and further advantages and uses thereof more readily apparent, when considered in view of the following detailed description of exemplary embodiments, taken with the accompanying drawings in which:

FIG. 1 is an elevational view of a door assembly constructed according to the teachings of the invention;

FIG. 5 is a cross-sectional plan view of the upper hinge shown in FIG. 1, taken between and in the direction of arrows V—V; and FIGS. 6 and 7 are perspective views of the door, and door assembly, respectively, illustrating steps in a method of constructing a door assembly according to the teachings of the invention.

DESCRIPTION OF PREFERRED EMBODIMENTS

Figure 4:
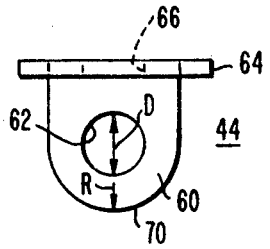
FIGS. 2, 3 and 4 are front and side elevational views, and a plan view, respectively, of a right angle hinge member constructed according to the teachings of the invention.

Referring now to the drawings, and to FIG. 1 in particular, there is shown a new and improved door assembly 10 constructed according to the teachings of the invention. Door assembly 10 includes a non-metallic wall panel 12. For example, the wall panel 12 may be constructed of wood for use as a wall portion of an elevator car. Wall panel 12 has first and second major opposed surfaces 14 and 16, respectively, and an opening 18 which extends between its surfaces 14 and 16. It will be noted that opening 18 is completely surrounded by the wall panel surfaces. Opening 18 is configured to receive a door 20.

Door 20, which may be formed of the same non-metallic material as wall panel 12, has first and second major opposed surfaces 22 and 24, respectively, first and second vertically oriented edge portions 26 and 28, respectively, and top and bottom edge portions 30 and 32, respectively.

Door 20 is pivotally mounted in opening 18 on a vertically oriented pivot axis 35 which intersects the top and bottom edge portions 30 and 32, respectively, of door 20, adjacent to a selected vertical edge, such as edge 26. Door 20 is mounted with its first major surface 22 in the same plane as the first major surface 14 of the wall panel 12. Door 20 will usually have the same thickness dimension as the wall panel 12, such as 0.62 inch, and therefore the second major surface 24 of door 20 will also be in the same plane as the second major surface 16 of the wall panel 12.

Door 20 is pivotally mounted within opening 18 via new and improved fastener means which includes upper and lower pivot hinge assemblies 34 and 36 mounted above and below the door 20, respectively.

Stops for limiting the pivotal movement of the door 20 once the door 20 is swung to its closed position, may be provided. For example, stop members 38 and 40 may be secured to the second major surface 16 of wall panel 12, adjacent to the opening 18, such that a portion of each stop member extends past a selected edge of the door opening to restrict the pivotal range of the door. As illustrated, stop members 38 and 40 are disposed above and below the opening 18 via fastener means 39 and 41, respectively, but any suitable arrangement may be employed.

Lock means 42 is provided for maintaining the door 20 in its closed position, and for releasing the door 20, when desired. Lock means 42 may be key-operated when the door 20 is to be opening only by authorized personnel, or it may have a knob for releasing the door, as desired.

The upper and lower pivot hinge assemblies 34 and 36, respectively, are of like construction. The upper pivot hinge assembly 34 includes a right angle member 44, elongated fastener means 46 for securing an arm of angle member 44 to the upper edge 30 of door 20, and additional fastener means 48 for securing the remaining arm of angle member 44 to the second major surface 16 of wall panel 12. In like manner, the lower pivot hinge assembly 36 includes a right angle member 50, elongated fastener means 52 for securing an arm of angle member 50 to the lower edge 32 of door 20, and additional fastener means 54 for securing the remaining arm of angle member 50 to the second major surface 16 of wall panel 12. It will be noted that the longitudinal axes of elongated fastener means 46 and 52 are disposed on the vertical pivot axis 35. Elongated fastener means are preferably threaded fasteners, such as wood screws, lag bolts, or the like.

Figure 2:
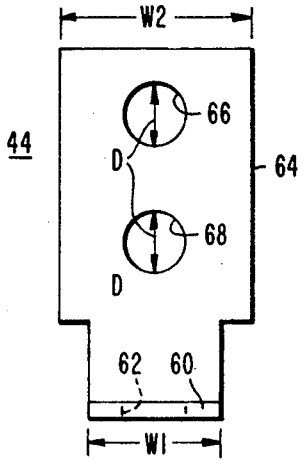
Figure 3:
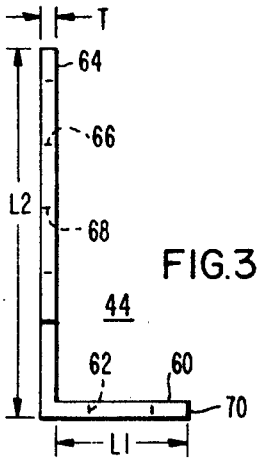

FIGS. 2, 3 and 4 are front and side elevational views, and a plan view, respectively, of right angle member 44 shown in FIG. 1. Right angle member 50 is of similar construction. Right angle member 44 includes a first arm portion 60 having an opening 62 for receiving elongated fastener means 46, and a second arm portion 64 having openings 66 and 68 for receiving fastener means 48. Right angle member 44 may be formed from a flat sheet of a suitable metal, such as steel, with the right angle member being initially formed with a substantially rectangular profile. The end 70 of the rectangular sheet which will ultimately be part of the first arm portion 60 is processed to form a curve, such as best shown in FIG. 4. As illustrated, the width of the rectangular sheet may also be narrowed adjacent to the end 70 which will ultimately be part of the first arm portion 60. The rectangular sheet may then be bent at the proper location to form the right angle configuration. Typical dimensions for right angle member 44, set forth only to illustrate a right angle member which has been successfully used on a 0.62 inch thick door having a width of 6.88 inches and a height of 8.88 inches, are as follows:

L1 - 0.56 inch
L2 - 1.38 inch
W1 - 0.50 inch
W2 - 0.75 inch
T - 0.060 inch
D - 0.25 inch
R - 0.25 inch FIG. 5 is a cross-sectional view of the upper pivot hinge assembly 34, taken between and in the direction of arrows V—V shown in FIG. 1. As best shown in FIG. 5, the top edge 30 of door 20 is mortised or recessed at 72 to receive the first arm portion 60 of right angle member 44, and also the head portion of elongated fastener 46. Recess 72 starts a predetermined dimension from the first major surface 22 of door 20, in order to conceal the first arm portion 60 and the head portion of the elongated fastener 46 when the door is viewed from the side of its first major surface. The recess 72 is wider than dimension W1 of the first arm portion 60, in order to enable the door 20 to swing to the position shown in phantom in FIG. 5, without interference between the curved end 70 of the first arm portion and the edge 74 of the recess. Vertical edge 26 of door 20 is spaced from the facing edge 76 of the wall panel adjacent thereto, by a dimension which enables the corner 78 of door 20 to swing to the position shown in phantom in FIG. 5, without interference. The fact that the pivot axis 34 is moved out "into the door", reduces the spacing required between the edge 26 of door 20 and edge 76 of the wall panel 12. It will be noted from FIGS. 1 and 5 that the elongated fastener 46 is always located between the upper edge 30 of the door 20 and the facing edge of wall panel 12, regardless of the position of the door 20. Thus, the hinge assemblies 34 and 36 are concealed and tamper-proof in all positions of the door. It is impossible to remove the elongated fasteners 46 and 52, once the wall panel 12 is placed into position, such as into an elevator car. The bottom edge 32 of door 20 is mortised in a manner similar to that hereinbefore described, and thus need not be described in detail. The mortise in the bottom edge 32 is referenced 80, and is illustrated in FIG. 6.

Figure 7:
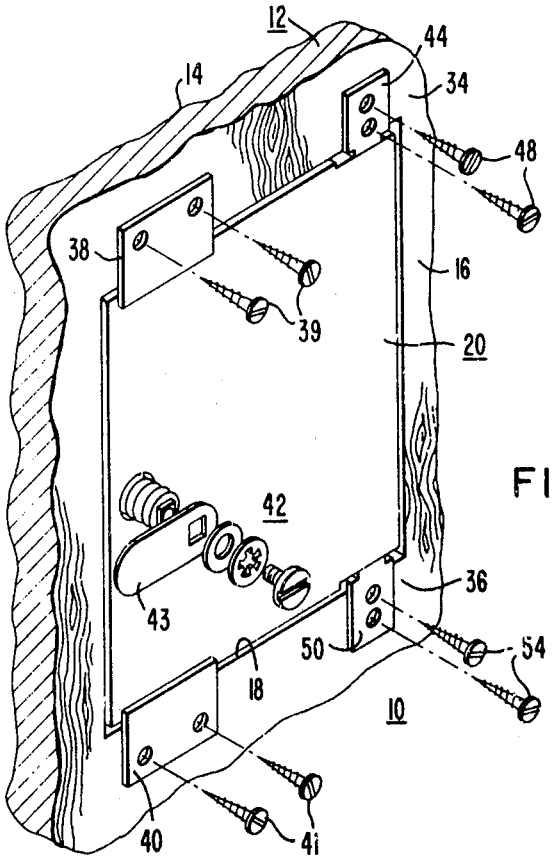

FIGS. 6 and 7 are perspective views of door 20, and door assembly 10, respectively, viewed from the rear of the door 20, i.e., from the side of the second major surface 24. FIGS. 6 and 7 illustrate a new and improved assembly method made possible by the teachings of the invention.

More specifically, door 20 is cut to shape, the mortises 72 and 80 are formed in the upper and lower edges 30 and 32, respectively, and an opening 82 is formed for receiving the lock assembly 42. The right angle members 44 and 50 are then secured to the door 20 via elongated fastener devices 46 and 52, respectively. Devices 46 and 52 may be tightened to the point where angle members 44 and 50 maintain the desired orientation and position.

The door assembly shown in FIG. 6 is then ready for installation in wall panel 12. Door 20 is positioned within opening 18 in the wall panel 12, and the clearances are set, such as by blocking the bottom and sides of the door 20 with suitable spacers. The second arm portions of the angle members 44 and 50 extend outwardly from the door in a common plane, and they will be disposed against the second major surface 16 of the wall panel 12. The second arm portions of angle members 44 and 50 are then secured to the wall panel 12 by fastening means 48 and 54, respectively, such as by wood screws. Stops 38 and 40 may then be positioned and secured to the second major surface 16 of wall panel 12 via fasteners 39 and 44, respectively, such as wood screws. Lock 42 may then be assembled within the opening 82 in the door 20. Lock 42 includes a rotatable member adjacent to the second major surface 24 of door 20, actuatable from the side of its first major surface 32. The rotatable member includes a tab 43 which cooperates with the second major surface 16 of the wall panel 12 to provide the locking function. The resulting assembly of the wall panel and door is then ready for installation, such as in an elevator car.

In summary, there has been disclosed a new and improved door assembly which includes concealed, tamper-proof hardware. The hardware does not require the purchase of special hinges, as the hinges may be easily fabricated from a piece of sheet metal. The hinges are pivot hinges, and the pivot pins are positioned such that they are impossible to remove, in any position of the door. The pivot pins initially function as fasteners which hold the angle members captive to the door, facilitating assembly of the door in an opening formed in a wall panel. The concealed tamper-proof hinges provide a structural rigidity which is maintained during usage of the door, preventing sagging of the door due to usage and wear.

We claim as our invention:

1. A door assembly, comprising:

a door having first and second major opposed surfaces, first and second vertically oriented edge portions, and top and bottom edge portions, a wall panel having first and second major opposed surfaces, and an opening which extends between its opposed surfaces configured to receive said door, and fastener means pivotally mounting said door in the opening defined by said wall panel, about a vertical pivot axis which intersects the top and bottom edge portions of said door adjacent to a selected edge portion thereof, with the first major surfaces of said door and wall panel being in a common plane when said door is in a selected position, said fasteners means including first and second angle members, each having first and second arm portions disposed at a right angle relative to one another, first and second elongated fastener means and additional fastener means, said first and second elongated fastener means being disposed to secure the first arm portions of said first and second angle members to the top and bottom edge portions, respectively, of said door, said additional fastener means being disposed to secure the second arm portions of said first and second angle members to the second major surface of said wall panel, said first and second elongated fastener means being disposed with their longitudinal axes coincident with said vertical pivot axis, such that said elongated fastener means perform both pivot and fastener functions.

2. The door assembly of claim 1 wherein the top and bottom edge portions of the door define recesses about the pivot axis which start a predetermined dimension from the first major surface and intersect the second major surface, with the depth of said recesses being selected to conceal the first arm portions of the first and second angle members, and the first and second elongated fastener means, when the wall panel is viewed from the side of the first major surface.

3. The door assembly of claim 1 including stop means, and fastener means securing said stop means to the second major surface of the wall panel such that a portion of said stop means extends past a selected edge of the opening defined by the wall panel, to restrict the pivotal range of the door.

4. The door assembly of claim 1 wherein the wall panel and door are constructed of non-metallic materials, and the first and second elongated fastener means are threadably engaged with the non-metallic material of the door.

5. The door assembly of claim 1 wherein the wall panel completely surrounds the door.

6. The door assembly of claim 1 including lock means mounted on the door having a rotatable member adjacent to the second major surface of the door, actuatable from the side of the first major surface, said rotatable member including a tab member which cooperates with the second major surface of the wall panel to prevent opening of the door when the tab portion overlaps the second major surface of the wall panel.

7. A method of installing a door in an opening defined by a wall panel, comprising the steps of:

providing a pair of right angle members having first and second arm portions, fastening the first arm portion of the pair of right angle members to the top and bottom edge portions of the door, with the second arm portions extending away from the door in a common plane, placing the door in an opening of a wall panel, with the second arm portions of the first and second right angle members contacting the wall panel, setting the clearances between the edges of the door and the edges of the opening, and fastening the second arm portions to the wall member.

8. The method of claim 7 including the steps of fastening a stop to the wall panel to limit the pivotal range of the door.

* * * * *